US007650943B2

(12) United States Patent
Baggs

(10) Patent No.: US 7,650,943 B2
(45) Date of Patent: Jan. 26, 2010

(54) HYDRAULIC CONTROL SYSTEM

(75) Inventor: Christopher David Baggs, Weston-Super-Mare (GB)

(73) Assignee: Vetco Gray Controls Limited, Nailsea, Bristol (GB)

( * ) Notice: Subject to any disclaimer, the term of this patent is extended or adjusted under 35 U.S.C. 154(b) by 287 days.

(21) Appl. No.: 11/316,138

(22) Filed: Dec. 22, 2005

(65) Prior Publication Data

US 2006/0157254 A1 Jul. 20, 2006

(30) Foreign Application Priority Data

Dec. 22, 2004 (GB) ..... 0428001.2

(51) Int. Cl.
*E21B 34/04* (2006.01)

(52) U.S. Cl. ..... 166/341; 166/66.6; 166/335; 166/368; 166/386

(58) Field of Classification Search ..... 166/341, 166/366, 368, 338, 250.01, 66.6
See application file for complete search history.

(56) References Cited

U.S. PATENT DOCUMENTS 3,865,142 A * 2/1975 Begun et al. ..... 137/635
3,894,560 A * 7/1975 Baugh ..... 137/606
4,174,000 A 11/1979 Milberger
4,378,848 A * 4/1983 Milberger ..... 166/351
6,046,685 A * 4/2000 Tubel ..... 340/853.2
6,484,806 B2 * 11/2002 Childers et al. ..... 166/351
6,644,410 B1 * 11/2003 Lindsey-Curran et al. ... 166/360
6,938,695 B2 * 9/2005 Williams ..... 166/341
6,988,554 B2 * 1/2006 Bodine et al. ..... 166/363
2004/0144543 A1 * 7/2004 Appleford et al. ..... 166/336
2004/0216884 A1 * 11/2004 Bodine et al. ..... 166/335
2005/0039923 A1 * 2/2005 Howe et al. ..... 166/368
2009/0038804 A1 * 2/2009 Going, III ..... 166/335

FOREIGN PATENT DOCUMENTS

GB 2401888 A 11/2004
GB 2405163 A 2/2005

* cited by examiner

*Primary Examiner*—Thomas A Beach
*Assistant Examiner*—Matthew R Buck
(74) *Attorney, Agent, or Firm*—Bracewell & Giuliani LLP

(57) ABSTRACT

A hydraulic control system for controlling an external device (4) at a well installation includes a control module (2) for generating electrical and/or optical control signals. A control pod (8) receives the control signals, the control pod controlling the external device. A hydraulic line (10) links the control pod to the external device (4) for controlling it.

10 Claims, 4 Drawing Sheets

HYDRAULIC CONTROL SYSTEM

CROSS-REFERENCE TO RELATED APPLICATION

This application claims the benefit of United Kingdom Patent Application No. 0428001.2, filed on Dec. 22, 2004, which hereby is incorporated by reference in its entirety.

FIELD OF THE INVENTION

The present invention relates to a hydraulic control system and a well installation incorporating the control system.

BACKGROUND OF THE INVENTION

In fluid extraction well installations there is a frequent requirement to control a small number of subsea hydraulic devices, typically valves for example, on a manifold or other structure from a well head tree, located typically 100 m distant from the manifold/structure. The traditional method of implementing this requirement is to install a hydraulic jumper between the tree and the manifold/structure hydraulic devices and use a tree 'subsea control module' (SCM) to control these devices.

FIG. 1 illustrates a traditional arrangement for control of hydraulic devices, in this example valves on a remote manifold. A tree 1 houses an SCM 2, which is connected to the manifold 3. Each valve 4 on the manifold 3 is fed via a hydraulic control line 5 such that a directional control valve (DCV) in the SCM 2 controls the operation of one valve 4. Each tree around the manifold would be connected similarly to a respective set of three valves. Historically, hose-type jumpers 5 have been employed to link the hydraulic control from the SCM to the manifold valves. However, with the current trend for subsea wells to be at greater depths, fluid well installation companies are specifying steel tube jumpers, which are extremely expensive, both to buy and to install.

The requirement to operate hydraulic devices remote from the well head means that additional DCVs have to be integrated into the SCM. In general, SCMs are designed and manufactured as 'common' in that they contain sufficient DCVs to meet the requirement of a typical well. However, when further remote devices have to be operated, the 'common' SCM has to be modified which incurs substantial design costs. If, on the other hand, the 'common' SCM is designed to accommodate additional remote devices, then in many 'straightforward' applications the surplus capacity makes the SCM more expensive.

Intelligent downhole systems are becoming more common and generally require three hydraulic functions, operating at high pressure (typically 10 k to 15 k psi), inside the SCM. Not all wells need an intelligent completion. It is usual to have a 'common' design of SCM, so in many cases these three functions are unused. Typically, an intelligent well system will also need an additional high pressure (HP) accumulator to ensure that operating the intelligent well does not adversely affect the 'surface controlled sub-surface safety valve' (SC-SSV) which is also on the HP supply and vice versa.

FIG. 2 illustrates a traditional arrangement for the control of downhole hydraulic devices, in this example valves 6. The tree 1 carries an SCM 2, which is connected to the downhole valves 6 via hydraulic feeds 7.

It should be noted that such systems are not the only systems available, for example British Patent Application No. GB 0319622.7 describes a decentralized control system which does not use an SCM. Likewise the system as described in British Patent No. GB 2264737 describes a further system in which the SCM is replaced by a multiplicity of integrated electronic and hydraulic functions in modules, such as smaller and dedicated electronic units and hydraulic units. In contrast to these two described systems, while this invention also employs modules that contain electrically operated hydraulic functions and perhaps electronic functions in some embodiments, in the present invention they are under the control of an SCM.

SUMMARY OF THE INVENTION

It is an aim of the present invention to obviate the need for steel tube jumpers and to allow standard minimum SCMs to be employed when there is a requirement to operate additional remote hydraulic devices.

This aim is achieved by the removal of the hydraulic controls for remote hydraulic devices, e.g. DCVs, from the tree mounted SCM and housing them instead in a separate 'pod' which is then located external to the SCM and in some applications close to the remote devices.

In accordance with a first aspect of the present invention, there is provided a hydraulic control system for controlling an external device at a well installation, comprising a control module for generating electrical and/or optical control signals, a control pod for receiving said control signals, the control pod comprising control means for controlling the external device, and a hydraulic line for linking the control means to said external device for the control thereof.

The control signals may be transmitted from the module to the pod via an electrically conductive coupling, e.g. via a serial data link, or via optical fiber.

A plurality of control means may be provided, linked to respective external devices by respective hydraulic lines.

The or each control means may be a valve, for example a directional control valve.

Preferably, the control pod is adapted to receive hydraulic fluid from a supply.

According to a second aspect of the present invention, there is provided a well installation for location underwater, comprising a well tree, a well, an external device and the hydraulic control means according to the first aspect of the present invention, wherein the control module is located at the tree.

The control pod may be located at a structure remote from the tree, for example a manifold. The external device may also be located at the structure. The pod may further receive low pressure hydraulic fluid from a supply located at the structure.

Alternatively, the control pod may be located at the tree. The pod may receive hydraulic fluid from a high pressure supply via the control module.

As a third alternative, the control pod may be mounted at or within the well.

The external device may be located within the well.

The external device may be a valve.

DETAILED DESCRIPTION OF THE INVENTION

Figure 1:
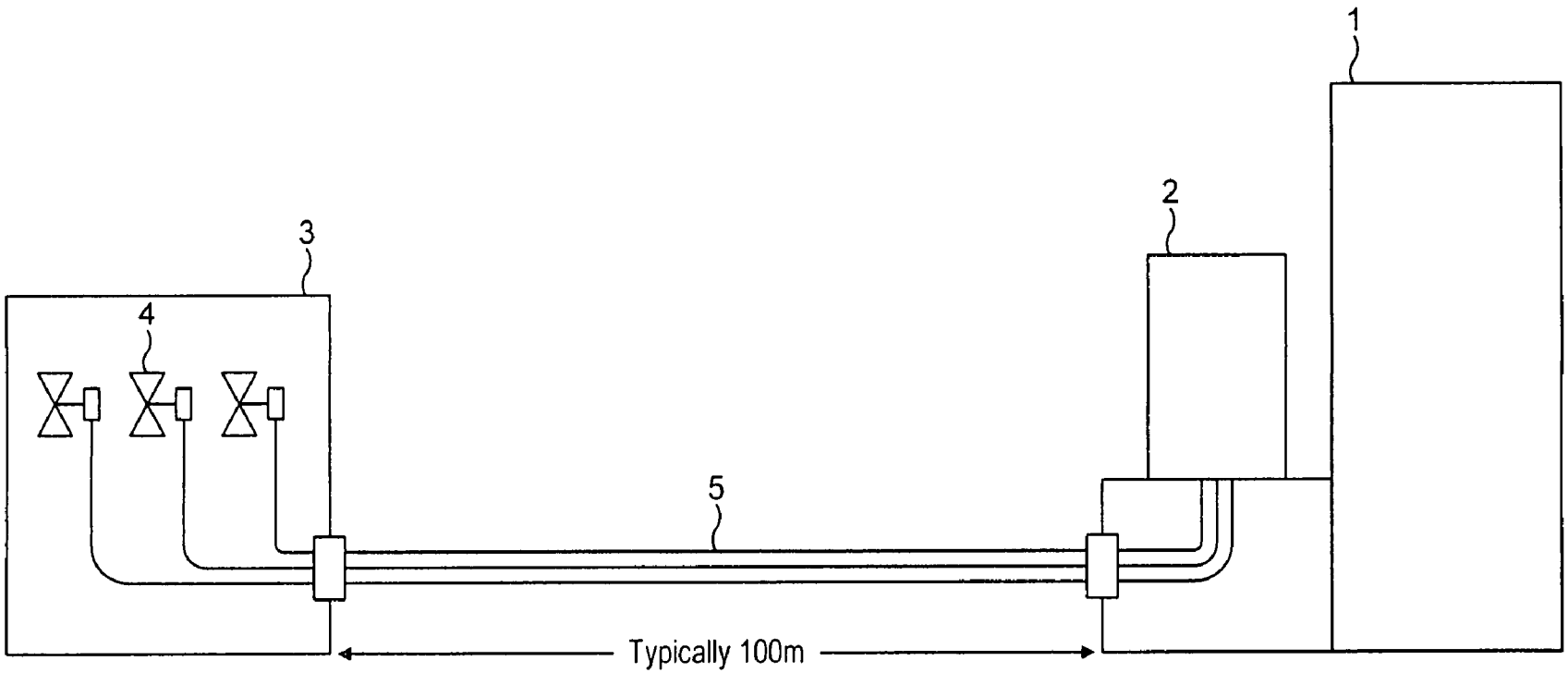
FIG. 1 PRIOR ART
FIG. 1 is a schematic of a prior art arrangement for control of valves on a subsea manifold.
Figure 2:
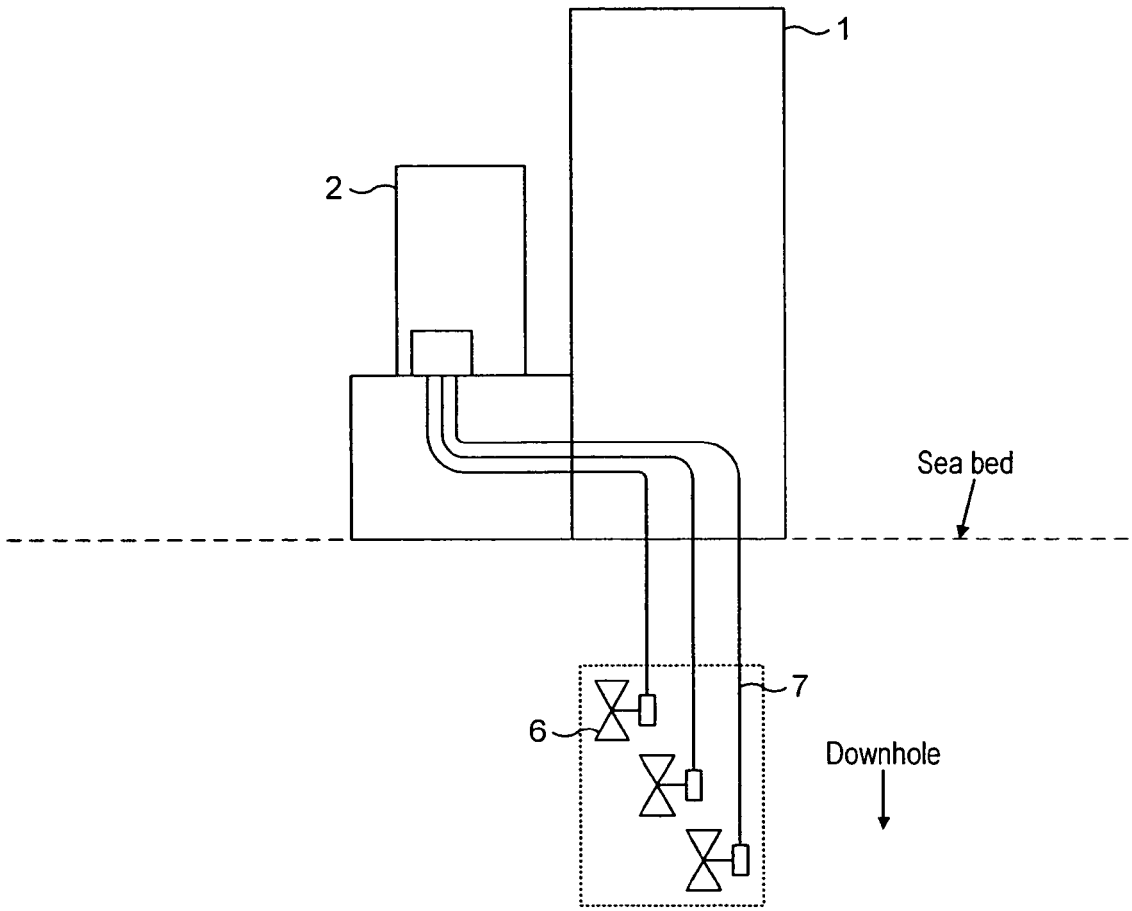
FIG. 2 PRIOR ART
FIG. 2 is a schematic of a prior art arrangement for control of downhole valves of a subsea well.
Figure 3:
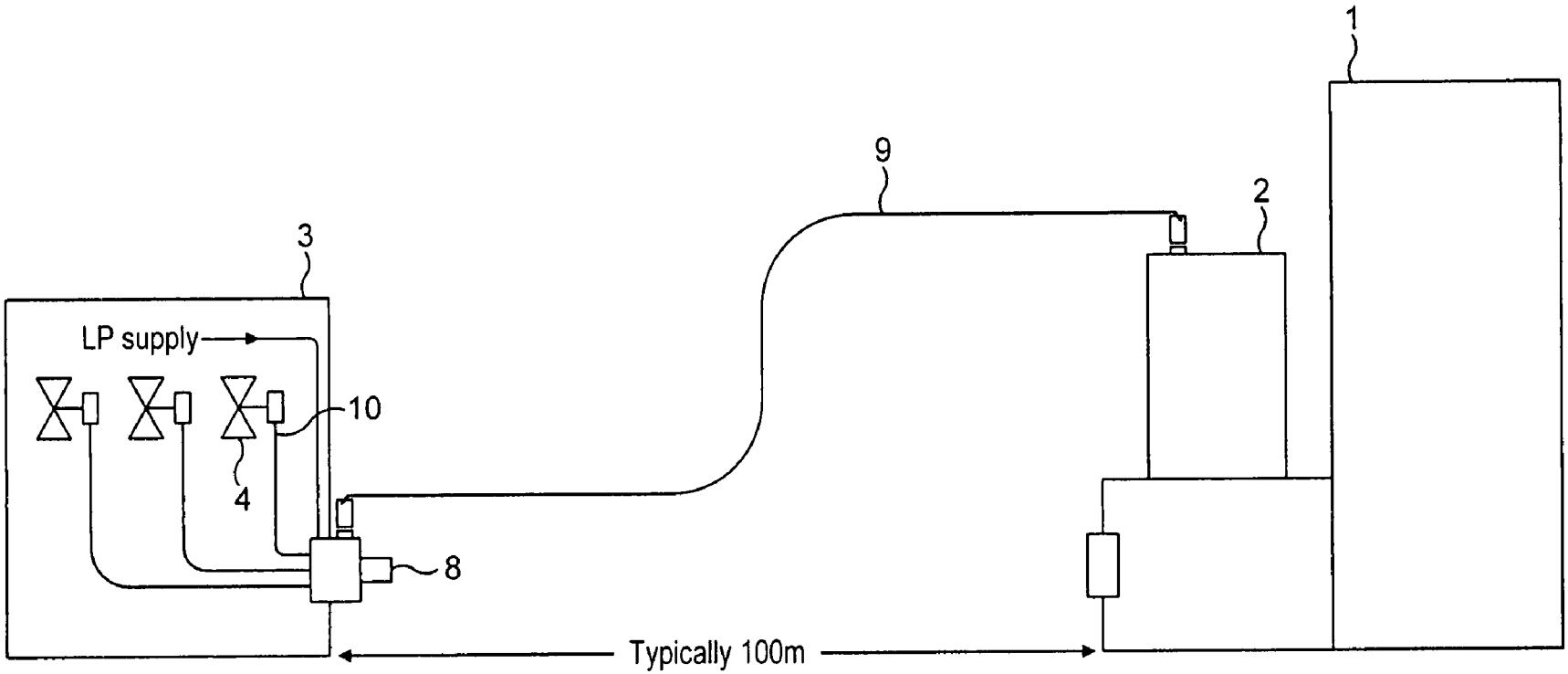
FIG. 3 is a schematic of an arrangement in accordance with this invention for control of valves on a subsea manifold.

FIG. 3 illustrates a first embodiment of the invention relating to the control of valves on a remote manifold/structure. In this embodiment, replacement of the hydraulic control lines from the tree with an electric or a fiber optic cable is achieved so that the need to modify or expand a minimal 'common' SCM is removed. An SCM 2 is housed on tree 1 and is connected either electrically or optically via a cable 9 to a pod 8, which is mounted on the remote manifold/structure 3. Each valve 4 on the manifold/structure 3 is fed via a hydraulic control line 10 from the pod 8. Electrical or optical signals from the SCM 2 operate DCVs in the pod 8 which in turn control the hydraulic power from a local source, designated 'LP (low pressure) supply' in FIG. 3, to each valve 4 via hydraulic feeds 10 internal to the manifold/structure 3. Thus the cost of steel hydraulic tubing from the SCM to the manifold/structure is obviated as is the need to add additional DCVs to the SCM.

Figure 4:
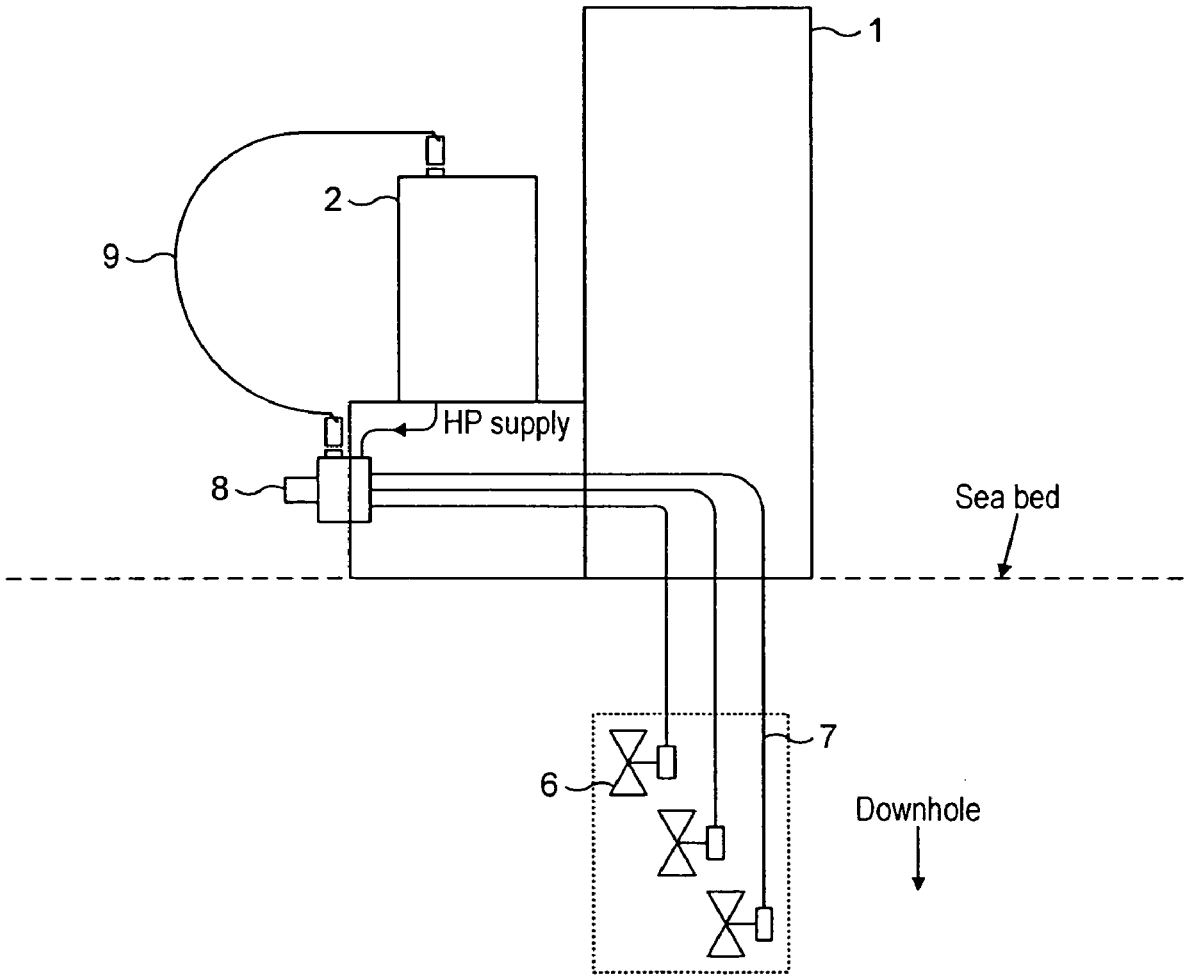
FIG. 4 is a schematic of an arrangement in accordance with this invention for control of downhole valves of a subsea well.

FIG. 4 illustrates a second embodiment of the invention relating to the control of downhole valves. In this embodiment, a pod can be located on the tree but external to the SCM thus avoiding the need to modify or expand a minimal standard SCM. An SCM 2 is housed on tree 1 and is connected either electrically or optically via cable 9 to the pod 8. In this embodiment, the pod 8 is also mounted on the tree 1. The pod 8 feeds downhole valves 4 via respective hydraulic control lines 7. Electrical or optical signals from the SCM 2 operate DCVs in the pod 8, which in turn control the hydraulic power from the SCM, designated 'HP (high pressure) supply' in FIG. 4, to each valve 4, via the hydraulic control lines 7. Thus the need to add additional DCVs to the SCM is obviated.

As an alternative form of this embodiment, a pod may be located downhole and the hydraulic feeds, which could be several kilometers long, replaced by a much cheaper electric or fiber optic cable, similar to the arrangement used in the first embodiment of FIG. 3.

In all these embodiments, the pod contains, as a minimum, electrically operated DCVs to provide hydraulic operation of the hydraulic devices at the location, powered from a local hydraulic source. When more than one device is to be operated it may be cost effective to replace the individual wires that provide electric control of each DCV with a serial data link, transmitting on its own separate pair of wires, or superimposed on the electric power, with decoding electronics incorporated in the pod. Alternatively the digital message could be transmitted to the pod via an optical fiber with a single pair of wires to provide electric power.

It will be apparent that the described systems provide the following advantages over the prior art systems:

1) Removal of both the need for long expensive steel hydraulic tubing, when used between a tree and a remote manifold/structure and the cost of installation which is expensive because of the need for special remotely operated vehicle (ROV) tools and facilities to install it.

2) Removal of the need to modify a 'common' SCM when used to control hydraulic devices remote from the tree. Normally the pod would only be fitted to trees that need it. Although the consequence of this is that all trees would still need a mounting plate for it to be plugged into, these are relatively cheap.

3) Enables replacement of the remote hydraulic device control i.e. a pod (e.g. by an ROV), without disrupting the operation of the SCM.

4) Provides the opportunity, when applied to intelligent wells, of having just one pod and deploying it when needed and then recovering it afterwards, since an intelligent well operation is often only needed only a few times in the system's approximate 25 year life.

5) For control of downhole hydraulic devices, the pod offers the opportunity to mount a small additional hydraulic accumulator inside the pod, although this may well have to sit on an auxiliary stab plate. Such an application may provide isolation of the SCM hydraulic fluid from the downhole hydraulic control system which, in terms of prevention of fluid contamination of the SCM hydraulics from the downhole hydraulics, is attractive to well installers.

The invention claimed is:

1. A hydraulic control system for controlling an external device at a well installation, comprising:

a control module for generating electrical or optical control signals;

the well installation for location underwater, a well tree, a well, and an external device wherein the control module is located at the tree;

a control pod for receiving said control signals and controlling the external device;

a hydraulic line linking the control pod to the external device for the control thereof;

wherein the control pod is located remote from the tree at a structure and receives hydraulic fluid from a local supply located at the structure without a hydraulic line between the tree and the structure for controlling the external device.

2. A control system according to claim 1, wherein the control signals are transmitted from the module to the pod via an electrically conductive coupling.

3. A control system according to claim 2, wherein the control signals are transmitted from the module to the pod via a serial data link.

4. A control system according to claim 1, wherein the control signals are transmitted from the module to the pod via optical fiber.

5. A control system according to claim 1, wherein the control pod is linked to a plurality of the external devices by respective hydraulic lines.

6. A control system according to claim 1, wherein the control pod contains a valve linked to the external device by the hydraulic line.

7. A control system according to claim 6, wherein the control pod contains a directional control valve linked to the external device by the hydraulic line.

8. A control system according to claim 1, wherein the structure comprises a manifold.

9. A control system according to claim 1, wherein the external device is located at the structure.

10. A control system according to claim 1, wherein the external device comprises a valve.

* * * * *

UNITED STATES PATENT AND TRADEMARK OFFICE

CERTIFICATE OF CORRECTION

PATENT NO. : 7,650,943 B2
APPLICATION NO. : 11/316138
DATED : January 26, 2010
INVENTOR(S) : Christopher David Baggs It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 454 days.

Signed and Sealed this

Twenty-eighth Day of December, 2010

David J. Kappos

David J. Kappos
*Director of the United States Patent and Trademark Office*